US009722369B1

(12) United States Patent
Hsu et al.

(10) Patent No.: US 9,722,369 B1
(45) Date of Patent: Aug. 1, 2017

(54) ELECTRICAL CONNECTOR

(71) Applicant: Cheng Uei Precision Industry Co., Ltd., New Taipei (TW)

(72) Inventors: Yi-Ching Hsu, New Taipei (TW); Pei-Yi Lin, New Taipei (TW); Kuo-Chin Lin, New Taipei (TW); Han-Wei Wang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/133,166

(22) Filed: Apr. 19, 2016

(51) Int. Cl.
*H01R 9/03* (2006.01)
*H01R 24/60* (2011.01)
*H01R 13/6597* (2011.01)
*H01R 107/00* (2006.01)

(52) U.S. Cl.
CPC ..... *H01R 24/60* (2013.01); *H01R 13/6597* (2013.01); *H01R 2107/00* (2013.01)

(58) Field of Classification Search
USPC ..... 439/607.34, 676, 607.05
See application file for complete search history.

(56) References Cited

U.S. PATENT DOCUMENTS 7,462,071 B1 * 12/2008 Wu ..... H01R 9/032 439/497
8,657,632 B2 * 2/2014 Liu ..... H01R 13/5219 439/660
9,022,800 B2 * 5/2015 Yang ..... H01R 13/6581 439/487
9,209,573 B1 * 12/2015 Chen ..... H01R 13/6581
9,281,643 B1 * 3/2016 Tseng ..... H01R 13/518
9,455,535 B1 * 9/2016 Chiang ..... H01R 13/6585
9,525,241 B1 * 12/2016 Su ..... H01R 13/6581
9,601,876 B2 * 3/2017 Jiang ..... H01R 13/6585
2015/0364871 A1 * 12/2015 Lin ..... H01R 13/6581 439/607.58
2016/0064869 A1 * 3/2016 Yu ..... H01R 24/60 439/607.05
2016/0149350 A1 * 5/2016 Kao ..... H01R 24/60 439/607.05
2016/0172791 A1 * 6/2016 Fan ..... H01R 13/6585 439/607.05
2016/0197443 A1 * 7/2016 Zhang ..... H01R 13/6585 439/607.05
2016/0261056 A1 * 9/2016 Jiang ..... H01R 13/6585

* cited by examiner

*Primary Examiner* — Amy Cohen Johnson
*Assistant Examiner* — Milagros Jeancharles
(74) *Attorney, Agent, or Firm* — Cheng-Ju Chiang

(57) ABSTRACT

An electrical connector includes an insulating housing, a dielectric body, a plurality of terminals integrally molded to the dielectric body, a shielding plate and a plurality of metal elements. The shielding plate is integrally molded to the dielectric body. The dielectric body together with the terminals and the shielding plate is assembled to a rear end of the insulating housing. The metal elements are mounted to a top surface and a bottom surface of the dielectric body. Each of the metal elements has a base plate, and a touch portion extended from the base plate. The base plates of the metal elements are mounted to the top surface and the bottom surface of the dielectric body, respectively. A tail end of the touch portion contacts the shielding plate. One side of the touch portion contacts one of the grounding terminals.

12 Claims, 6 Drawing Sheets

ELECTRICAL CONNECTOR

BACKGROUND OF THE INVENTION

1. Field of the Invention

The present invention generally relates to a connector, and more particularly to an electrical connector.

2. The Related Art

With the wide application and the development of electronic technologies, volumes of connectors are smaller and transmission speeds of the connectors are higher, so high-frequency characteristics are requested more rigorous. When an electrical connector is used in an electronic device, crosstalk phenomena are easily caused. Especially, when a distance between signals and a reference plane of the electrical connector is increased or when strengths of the signals are increased or when a distance between every two adjacent terminals of the electrical connector is very close, near-end and far-end crosstalk interferences are caused that affects an integrity of the signals and results in a delay of the signals. Thus accuracies of transmitting the signals of the electrical connector are lowered.

In view of the above-mentioned problems of the electrical connector, an innovative electrical connector need be developed for effectively reducing the near-end and far-end crosstalk interferences.

SUMMARY OF THE INVENTION

An object of the present invention is to provide an electrical connector. The electrical connector includes an insulating housing, a dielectric body, a plurality of terminals integrally molded to the dielectric body, a shielding plate and a plurality of metal elements. The insulating housing has a top wall, a bottom wall, two lateral walls and a rear wall. An insertion space is formed among the top wall, the bottom wall, the two lateral walls and the rear wall. The terminals include signal terminals and grounding terminals. The shielding plate is integrally molded to the dielectric body. The dielectric body together with the terminals and the shielding plate is assembled to a rear end of the insulating housing. The metal elements are mounted to a top surface and a bottom surface of the dielectric body. Each of the metal elements has a base plate, and a touch portion extended from the base plate. The base plates of the metal elements are mounted to the top surface and the bottom surface of the dielectric body, respectively. A tail end of the touch portion contacts the shielding plate. One side of the touch portion contacts one of the grounding terminals.

As described above, the tail ends of the touch portions of the metal elements contact the shielding plate, and the one side of the touch portion of each of the metal elements contacts the one of the grounding terminals, so that a distance between signals and a reference plane of the electrical connector is decreased, a mutual inductance between specific circuits is effectively decreased, and an integrity of the signals is ensured. Thus, accuracies of transmitting the signals of the electrical connector are higher. As a result, near-end and far-end crosstalk interferences are effectively improved.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
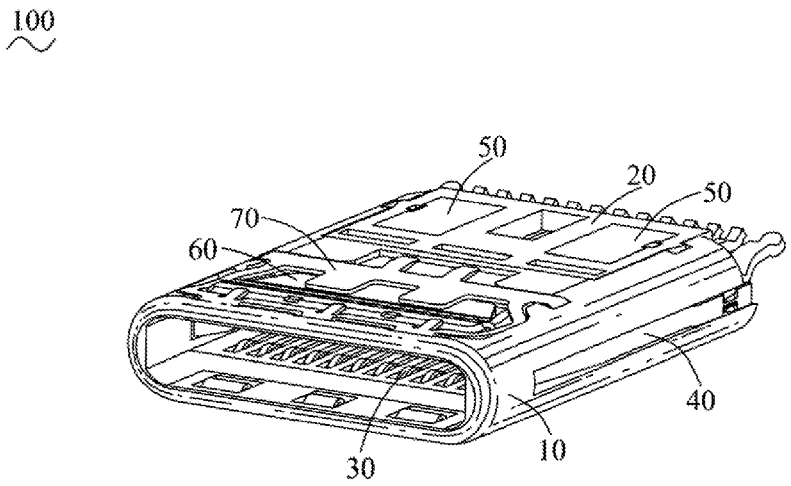
FIG. 1 is a perspective view of an electrical connector in accordance with an embodiment of the present invention.
Figure 2:
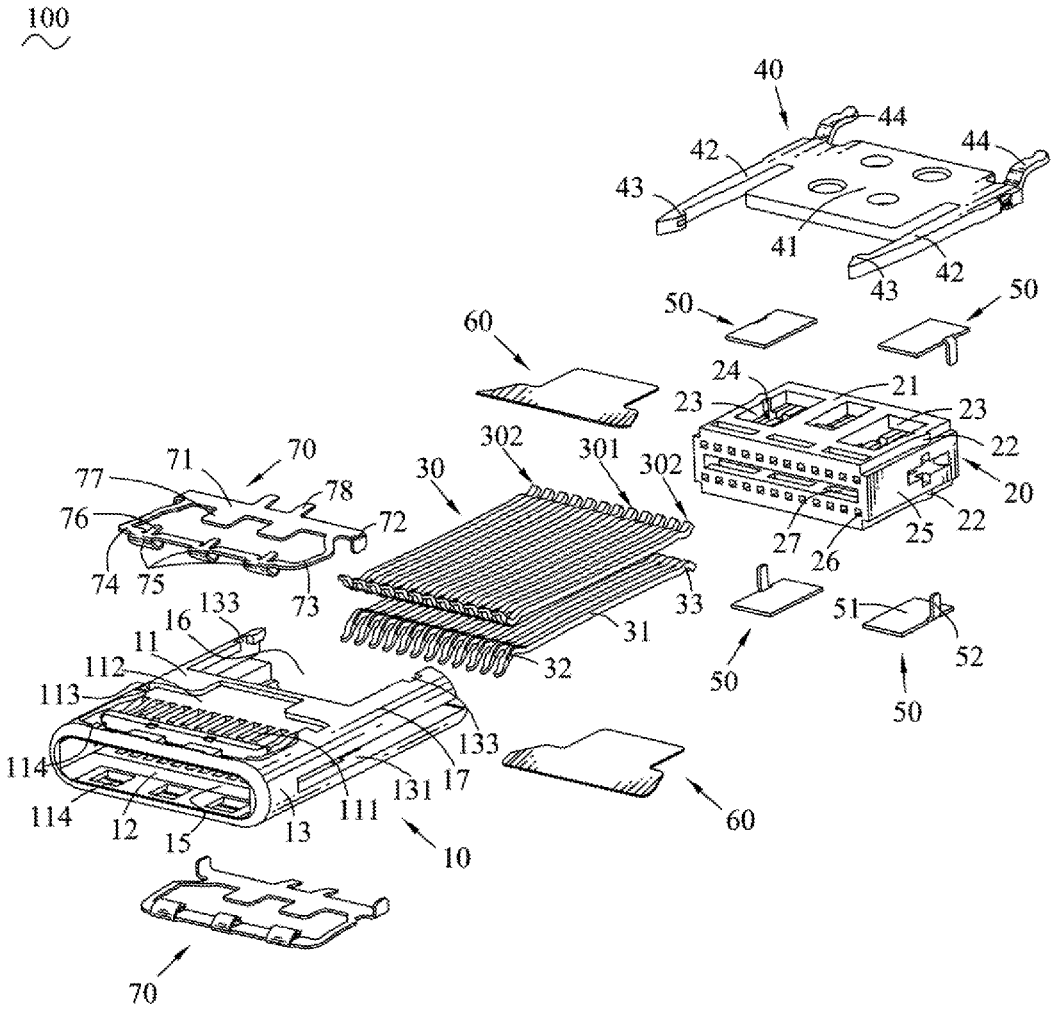
FIG. 2 is an exploded view of the electrical connector of FIG. 1.

With reference to FIG. 1 and FIG. 2, an electrical connector 100 in accordance with an embodiment of the present invention is shown. The electrical connector 100 includes an insulating housing 10, a dielectric body 20, a plurality of terminals 30, a shielding plate 40 and a plurality of metal elements 50.

Figure 3:
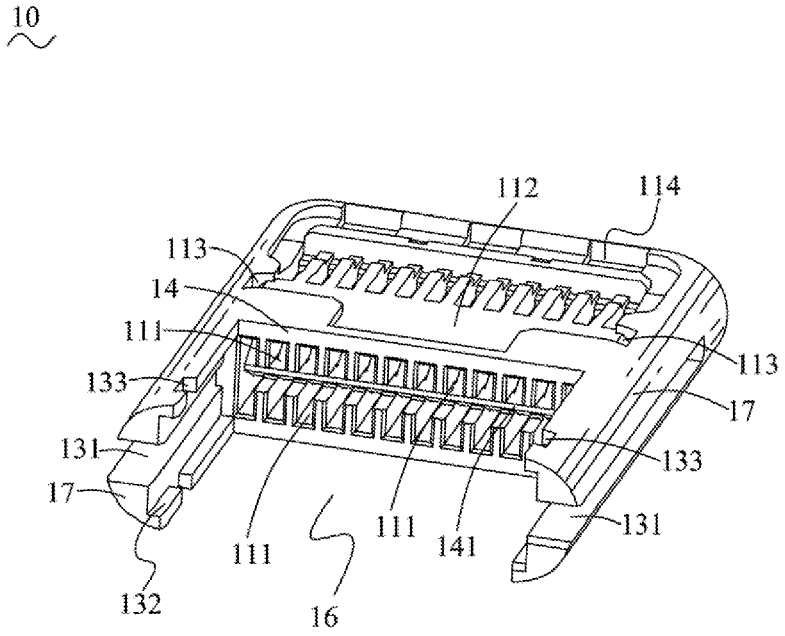
FIG. 3 is a perspective view of an insulating housing of the electrical connector of FIG. 1.

Referring to FIG. 1 to FIG. 3, the insulating housing 10 has a top wall 11, a bottom wall 12 opposite to the top wall 11, two lateral walls 13 connected between the top wall 11 and the bottom wall 12, and a rear wall 14 connected with rear ends of the top wall 11, the two lateral walls 13 and the bottom wall 12. An insertion space 15 is formed among the top wall 11, the bottom wall 12, the two lateral walls 13 and the rear wall 14. Rear ends of the two lateral walls 13 of the insulating housing 10 extend rearward to form two extending walls 17. The insulating housing 10 defines two rows of parallel terminal grooves 111 respectively penetrating through the top wall 11 and the bottom wall 12 of the insulating housing 10 along an up-down direction, and longitudinally penetrating through the rear wall 14 of the insulating housing 10.

The two rows of the terminal grooves 111 include an upper row of the terminal grooves 111 and a lower row of the terminal grooves 111 extending longitudinally. Fronts of the upper row of the terminal grooves 111 penetrate through the top wall 11 of the insulating housing 10 along the up-down direction, rears of the upper row of the terminal grooves 111 longitudinally penetrate through an upper portion of the rear wall 14 of the insulating housing 10. Fronts of the lower row of the terminal grooves 111 penetrate through the bottom wall 12 of the insulating housing 10 along the up-down direction, rears of the lower row of the terminal grooves 111 longitudinally penetrate through a lower portion of the rear wall 14 of the insulating housing 10. The upper row of the terminal grooves 111 are arranged transversely. The lower row of the terminal grooves 111 are arranged transversely.

A top surface of the top wall 11 and a bottom surface of the bottom wall 12 of the insulating housing 10 are recessed inward to form two fastening cavities 112 communicated with the terminal grooves 111. One of the fastening cavities 112 in the top wall 11 is communicated with the upper row of the terminal grooves 111. The other fastening cavity 112 in the bottom wall 12 is communicated with the lower row of the terminal grooves 111. Two opposite sides of an inner wall of each of the fastening cavities 112 open two insertion holes 113 communicated with the insertion space 15. A front end of the inner wall of each of the fastening cavities 112 opens a plurality of avoiding grooves 114 communicated with the insertion space 15. A middle of a rear surface of the rear wall 14 of the insulating housing 10 is recessed frontward to form a fastening slot 141 extending transversely.

The two extending walls 17 are spaced from each other to form an assembling opening 16 between the two extending walls 17. The insulating housing 10 opens two clamping grooves 131 transversely penetrating through middles of the two lateral walls 13 and the two extending walls 17, and longitudinally penetrating through rear surfaces of the two extending walls 17 of the insulating housing 10, respectively. Front ends of the two clamping grooves 131 are communicated with the insertion space 15. Rear ends of the two clamping grooves 131 are communicated with the assembling opening 16. An upper side and a lower side of each side wall of the assembling opening 16 extend inward to form a pair of guide rails 132 for guiding the dielectric body 20. An inner side of each of the guide rails 132 is recessed outward to form a restricting groove 133.

Figure 4:
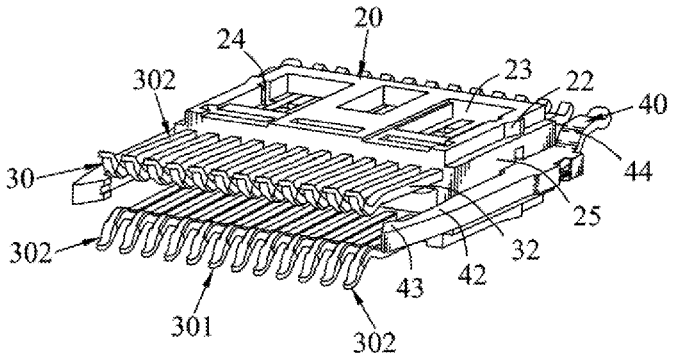
FIG. 4 is an assembling view showing that a dielectric body, a plurality of terminals and a shielding plate of the electrical connector of FIG. 1.
Figure 5:
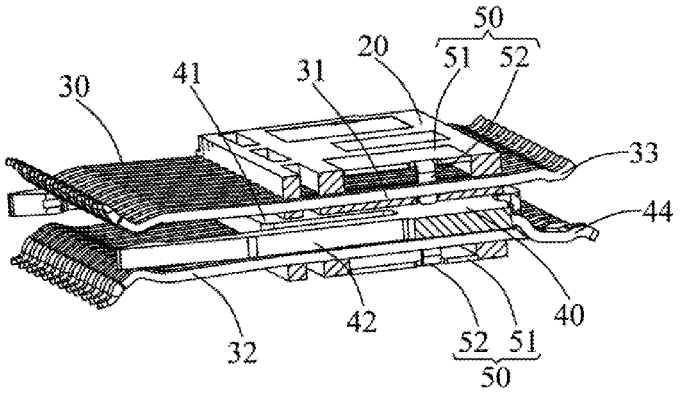
FIG. 5 is a sectional view of the dielectric body, the plurality of terminals and the shielding plate of the electrical connector of FIG. 4.
Figure 6:
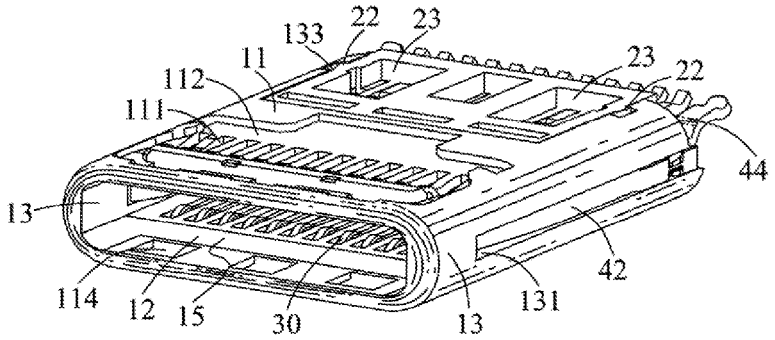
FIG. 6 is an assembling view showing that the insulating housing, the dielectric body, the plurality of terminals and the shielding plate of the electrical connector of FIG. 1.

Referring to FIG. 2, FIG. 4 and FIG. 5, the dielectric body 20 has a base body 21. Several portions of upper ends and lower ends of two opposite sides of the base body 21 protrude outward to form a plurality of restricting blocks 22. A substantial middle of the base body 21 defines a locating slot 27 penetrating through a front surface and a rear surface of the base body 21. Several portions of a top surface and a bottom surface of the base body 21 are recessed inward to form a plurality of recesses 23. A portion of an outer side of each of the recesses 23 spreads outward and extends to the locating slot 27 to form an insertion slot 24. Middles of the two opposite sides of the base body 21 protrude outward to form two protruding blocks 25. The base body 21 defines a plurality of fixing grooves 26 longitudinally penetrating through the base body 21 and arranged in two rows along the up-down direction. The two rows of the fixing grooves 26 include an upper row of the fixing grooves 26, and a lower row of the fixing grooves 26 located under the upper row of the fixing grooves 26. The upper row of the fixing grooves 26 longitudinally penetrate through an upper portion of the base body 21 and are arranged transversely. The lower row of the fixing grooves 26 longitudinally penetrate through a lower portion of the base body 21 and are arranged transversely.

Referring to FIG. 2, FIG. 4 and FIG. 5, the terminals 30 are integrally molded to the dielectric body 20 and arranged in two rows along the up-down direction. The terminals 30 include a plurality of signal terminals 301 and four grounding terminals 302. Each of the terminals 30 has an elongated fastening portion 31, a contact portion 32 extended frontward and then arched inward from a front end of the fastening portion 31, and a soldering portion 33 extended rearward and then arched inward from a rear end of the fastening portion 31. The two rows of the terminals 30 include an upper row of the terminals 30 including two grounding terminals 302, and a lower row of the terminals 30 including two grounding terminals 302.

The upper row of the terminals 30 are molded to the upper portion of the base body 21 and arranged transversely. The lower row of the terminals 30 are molded to the lower portion of the base body 21 and arranged transversely. The upper row of the terminals 30 are molded to the upper row of the fixing grooves 26. The lower row of the terminals 30 are molded to the lower row of the fixing grooves 26. The lower row of the terminals 30 is located under the upper row of the terminals 30. Preferably, the upper row of the terminals 30 is symmetrical to the lower row of the terminals 30. The fastening portion 31 of each of the terminals 30 is molded in the base body 21. The contact portions 32 of the terminals 30 project beyond the front surface of the base body 21. The soldering portions 33 of the terminals 30 project beyond the rear surface of the base body 21.

Referring to FIG. 2, FIG. 4 and FIG. 5, the shielding plate 40 is integrally molded to the dielectric body 20 and located between the two rows of the terminals 30. The shielding plate 40 has a main plate 41 disposed horizontally. Two opposite sides of the main plate 41 protrude outward and then extend frontward to form two clamping arms 42. Front ends of inner surfaces of the two clamping arms 42 protrude face to face to form two clamping portions 43. Rear edges of the two clamping arms 42 slantwise extend upward and rearward, then bent rearward and further arched downward to form two soldering arms 44. The main plate 41 is molded in the locating slot 27 of the dielectric body 20. A front end of the main plate 41 projects beyond the front surface of the base body 21. The dielectric body 20 is located between the two clamping arms 42. Front ends of the clamping arms 42 exceed the front surface of the base body 21 of the dielectric body 20. The two soldering arms 44 exceed two side surfaces of the dielectric body 20, respectively, and a rear surface of the dielectric body 20.

Referring to FIG. 2, each of the metal elements 50 has a base plate 51, and a touch portion 52 extended from the base plate 51. The touch portion 52 is a bending plate bent from one side of the base plate 51.

Referring to FIG. 1 and FIG. 2, the electrical connector 100 further includes two insulation films 60 and two shielding elements 70. The two insulation films 60 are mounted to the top wall 11 and the bottom wall 12 of the insulating housing 10, respectively. Each of the insulation films 60 is of a board shape. The two shielding elements 70 are mounted to the top wall 11 and the bottom wall 12 of the insulating housing 10, respectively. The two shielding elements 70 partially cover the two insulation films 60, respectively. Each of the shielding elements 70 has a plate-shaped fastening piece 71. Two opposite sides of the fastening piece 71 are bent inward to form two insertion arms 72.

Two opposite sides of a front edge of the fastening piece 71 extend frontward to form two elastic arms 73 arched outward. Each of the elastic arms 73 is shown an arch-shape. Distal ends of the two elastic arms 73 are connected with a connecting arm 74. Several portions of a front edge of the connecting arm 74 are curved inward and rearward, and then arched inward to form a plurality of resilient portions 75. Several portions of a rear edge of the connecting arm 74 forms a plurality of ground portions 76 extending rearward and inclining outward. The ground portions 76 are respectively corresponding to the resilient portions 75. Two opposite sides of a middle of the front edge of the fastening piece 71 extend frontward to form two extending arms 77. Two portions of a middle of the rear edge of the fastening piece 71 slantwise extend rearward and outward to form two abutting portions 78.

Referring to FIG. 1 to FIG. 6, in assembly, the dielectric body 20 together with the terminals 30 and the shielding plate 40 is assembled frontward to a rear end of the insulating housing 10. The front end of the main plate 41 is fastened in the fastening slot 141. The dielectric body 20 is assembled in the assembling opening 16 of the insulating housing 10. The two protruding blocks 25 are guided along the guide rails 132. Each of the restricting blocks 22 is restricted in the restricting groove 133 for preventing the dielectric body 20 breaking away from the insulating housing 10. The contact portion 32 of each of the terminals 30 is received in one of the terminal grooves 111 and partially projects into the insertion space 15. The soldering portion 33 of each of the terminals 30 projects beyond the insulating housing 10. The two clamping arms 42 are received in the two clamping grooves 131. The two clamping portions 43 project into the insertion space 15 of the insulating housing 10. The soldering arms 44 project beyond the insulating housing 10. The electrical connector 100 is matched with a butting connector (not shown). The butting connector (not shown) is inserted into the insertion space 15 of the insulating housing 10. The two clamping portions 43 clamp the butting connector.

The insulation films 60 are respectively mounted to the two fastening cavities 112 and cover the front ends of the terminals 30. The two shielding elements 70 are fastened to the two fastening cavities 112 and partially cover the two insulation films 60, respectively. The fastening piece 71, the elastic arms 73, the connecting arm 74, the two extending arms 77 and the two abutting portions 78 of each of the two shielding elements 70 are received in one of the two fastening cavities 112. The fastening pieces 71, the two extending arms 77 and the two abutting portions 78 of the two shielding elements 70 block the two insulation films 60 from falling off by virtue of the two shielding elements 70 partially covering the respective insulation films 60. The two insertion arms 72 of each of the shielding elements 70 are inserted into the two insertion holes 113, respectively for fastening each of the shielding elements 70 firmly. The resilient portions 75 are received in the avoiding grooves 114 and project into the insertion space 15.

The ground portions 76 and the abutting portions 78 of the two shielding elements 70 project beyond the top surface of the top wall 11 and the bottom surface of the bottom wall 12, respectively. Each of the insulation films 60 is clamped between the terminals 30 and one of the shielding elements 70. When the terminals 30 expand outward to generate elastic deformations, the insulation films 60 are capable of effectively preventing the terminals 30 contacting with the shielding elements 70 for ensuring a better electrical performance of the electrical connector 100.

At last, the metal elements 50 are mounted to a top surface and a bottom surface of the dielectric body 20. The base plates 51 of the metal elements 50 are mounted to the top surface and the bottom surface of the dielectric body 20, respectively. A tail end of the touch portion 52 contacts the shielding plate 40. One side of the touch portion 52 of each of the metal elements 50 contacts one of the grounding terminals 302. Specifically, the base plates 51 of the metal elements 50 are received in the recesses 23. The touch portion 52 of each of the metal elements 50 passes through the insertion slot 24. The tail ends of the touch portions 52 contact the main plate 41 of the shielding plate 40. The fastening portion 31 of each of the grounding terminals 302 is partially exposed to the insertion slot 24. The touch portions 52 of the metal elements 50 contact the fastening portions 31 of the grounding terminals 302.

As described above, the tail ends of the touch portions 52 of the metal elements 50 contact the shielding plate 40, and the one side of the touch portion 52 of each of the metal elements 50 contacts the one of the grounding terminals 302, so that a distance between signals and a reference plane of the electrical connector 100 is decreased, a mutual inductance between specific circuits is effectively decreased, and an integrity of the signals is ensured. Thus, accuracies of transmitting the signals of the electrical connector 100 are higher. As a result, near-end and far-end crosstalk interferences are effectively improved.

What is claimed is:

1. An electrical connector, comprising:

an insulating housing having a top wall, a bottom wall, two lateral walls and a rear wall, an insertion space being formed among the top wall, the bottom wall, the two lateral walls and the rear wall;

a dielectric body;

a plurality of terminals integrally molded to the dielectric body, the terminals including signal terminals and grounding terminals;

a shielding plate integrally molded to the dielectric body, the dielectric body together with the terminals and the shielding plate being assembled to a rear end of the insulating housing; and a plurality of metal elements mounted to a top surface and a bottom surface of the dielectric body, each of the metal elements having a base plate, and a touch portion extended from the base plate, the base plates of the metal elements being mounted to the top surface and the bottom surface of the dielectric body, respectively, a tail end of the touch portion contacting the shielding plate, one side of the touch portion contacting one of the grounding terminals;

wherein the touch portion is a bending plate bent from one side of the base plate;

wherein the dielectric body has a base body, several portions of a top surface and a bottom surface of the base body are recessed inward to form a plurality of recesses, the base plates of the metal elements are received in the recesses;

wherein a middle of the base body defines a locating slot penetrating through a front surface and a rear surface of the base body, a portion of an outer side of each of the recesses spreads outward and extends to the locating slot to form an insertion slot, each of the terminals has a fastening portion molded in the base body, the fastening portion of each of the grounding terminals is partially exposed to the insertion slot, the shielding plate has a main plate molded in the locating slot, the touch portion of each of the metal elements passes through the insertion slot, the tail ends of the touch portions of the metal elements contact the main plate, the touch portions of the metal elements contact the fastening portions of the grounding terminals.

2. The electrical connector as claimed in claim 1, wherein the terminals are arranged in two rows along an up-down direction, each of the terminals has a contact portion extended frontward and then arched inward from a front end of the fastening portion, and a soldering portion extended rearward and then arched inward from a rear end of the fastening portion, the contact portions of the terminals project beyond the front surface of the base body, the soldering portions of the terminals project beyond the rear surface of the base body.

3. The electrical connector as claimed in claim 2, wherein rear ends of the two lateral walls of the insulating housing extend rearward to form two extending walls, the two extending walls are spaced from each other to form an assembling opening between the two extending walls, the dielectric body is assembled in the assembling opening.

4. The electrical connector as claimed in claim 3, wherein the insulating housing defines two rows of terminal grooves respectively penetrating through the top wall and the bottom wall of the insulating housing along an up-down direction, and longitudinally penetrating through the rear wall of the insulating housing, the contact portion of each of the terminals is received in one of the terminal grooves and partially projects into the insertion space, the soldering portion of each of the terminals projects out of the insulating housing.

5. The electrical connector as claimed in claim 4, wherein the insulating housing opens two clamping grooves transversely penetrating through middles of the two lateral walls and the two extending walls, and longitudinally penetrating through rear surfaces of the two extending walls, respectively, two opposite sides of the main plate protrude outward and then extend frontward to form two clamping arms, the dielectric body is located between the two clamping arms and are received in the two clamping grooves, respectively.

6. The electrical connector as claimed in claim 5, wherein front ends of inner surfaces of the two clamping arms protrude face to face to form two clamping portions, the two clamping portions project into the insertion space.

7. The electrical connector as claimed in claim 5, wherein rear edges of the two clamping arms slantwise extend upward and rearward, then bent rearward to form two soldering arms, the two soldering arms exceed two side surfaces of the dielectric body, respectively, and a rear surface of the dielectric body.

8. The electrical connector as claimed in claim 3, wherein an upper side and a lower side of each side wall of the assembling opening extend inward to form a pair of guide rails, an inner side of each of the guide rails is recessed outward to form a restricting groove, middles of two opposite sides of the base body protrude outward to form two protruding blocks, several portions of upper ends and lower ends of the two opposite sides of the base body protrude outward to form a plurality of restricting blocks, the two protruding blocks are guided along the guide rails, each of the restricting blocks is restricted in the restricting groove.

9. The electrical connector as claimed in claim 1, further comprising two insulation films, a top surface of the top wall and a bottom surface of the bottom wall of the insulating housing being recessed inward to form two fastening cavities, each of the insulation films being of a board shape, the insulation films being respectively mounted to the two fastening cavities.

10. The electrical connector as claimed in claim 9, further comprising two shielding elements fastened to the two fastening cavities and partially covering the two insulation films, respectively.

11. The electrical connector as claimed in claim 10, wherein two opposite sides of an inner wall of each of the fastening cavities open two insertion holes, each of the shielding elements has a plate-shaped fastening piece, two opposite sides of the fastening piece are bent inward to form two insertion arms, the two insertion arms of each of the shielding elements are inserted into the two insertion holes, respectively.

12. The electrical connector as claimed in claim 11, wherein a front end of the inner wall of each of the fastening cavities opens a plurality of avoiding grooves communicated with the insertion space, two opposite sides of a front edge of the fastening piece extend frontward to form two elastic arms, distal ends of the two elastic arms are connected with a connecting arm, several portions of a front edge of the connecting arm are curved inward and rearward, and then arched inward to form a plurality of resilient portions, the resilient portions are received in the avoiding grooves and project into the insertion space.

* * * * *